United States Patent [19]

Witte et al.

[11] 4,402,279

[45] Sep. 6, 1983

[54] TREATMENT CHAMBER

[76] Inventors: Stefan H. Witte, Göketdrsg. 49; Björn Heed, Litlandagatan 19, both of Gothenburg, Sweden

[21] Appl. No.: 341,986

[22] PCT Filed: May 12, 1981

[86] PCT No.: PCT/SE81/00143

§ 371 Date: Jan. 11, 1982

§ 102(e) Date: Jan. 11, 1982

[51] Int. Cl.[3] ..... B05B 13/00; B05B 15/04

[52] U.S. Cl. ..... 118/326; 98/115 SB; 118/DIG. 7; 427/424

[58] Field of Search ..... 118/70, 326, 324, DIG. 7; 98/115 SB; 427/424

[56] References Cited

U.S. PATENT DOCUMENTS

| | | | |
|---|---|---|---|
| 2,486,877 | 11/1949 | Ransburg et al. | 118/326 X |
| 2,854,946 | 10/1958 | Norris | 118/326 X |
| 3,870,016 | 3/1975 | Schneider | 118/326 X |
| 3,874,970 | 4/1975 | Dunn | 156/429 X |
| 4,323,030 | 4/1982 | Lehmann | 118/326 X |

*Primary Examiner*—Shrive P. Beck

[57] ABSTRACT

The present invention relates to a treatment chamber, which by way of example is intended to be used as a spray booth.

By means of the present invention a treatment chamber is obtained, which is easy to clean and which permits the insertion of treatment means (22), such as for example spray nozzles for paint (22), at optional places along the whole length of the treatment chamber.

This object is obtained by a preferably endless band (1), which is spirally rerouted and displaceable in its longitudinal direction, forming the lateral walls of the treatment chamber.

10 Claims, 5 Drawing Figures

TREATMENT CHAMBER

The present invention relates to a treatment chamber intended to be used for example as a spray booth.

It is a principal object of the present invention to provide a treatment chamber of the kind mentioned, which is easy to clean, by way of example by removing excess colour in case it is used as a spray booth and in connection with such application permits the installation of for example nozzles for colour spray at optional points along the longitudinal extension of the treatment chamber.

This purpose is obtained by means of a treatment chamber according to the present invention, which is substantially characterized by an endless band, which is spirally rerouted and displaceable in the longitudinal direction of the chamber and forms the lateral walls of the same.

Figure 1:
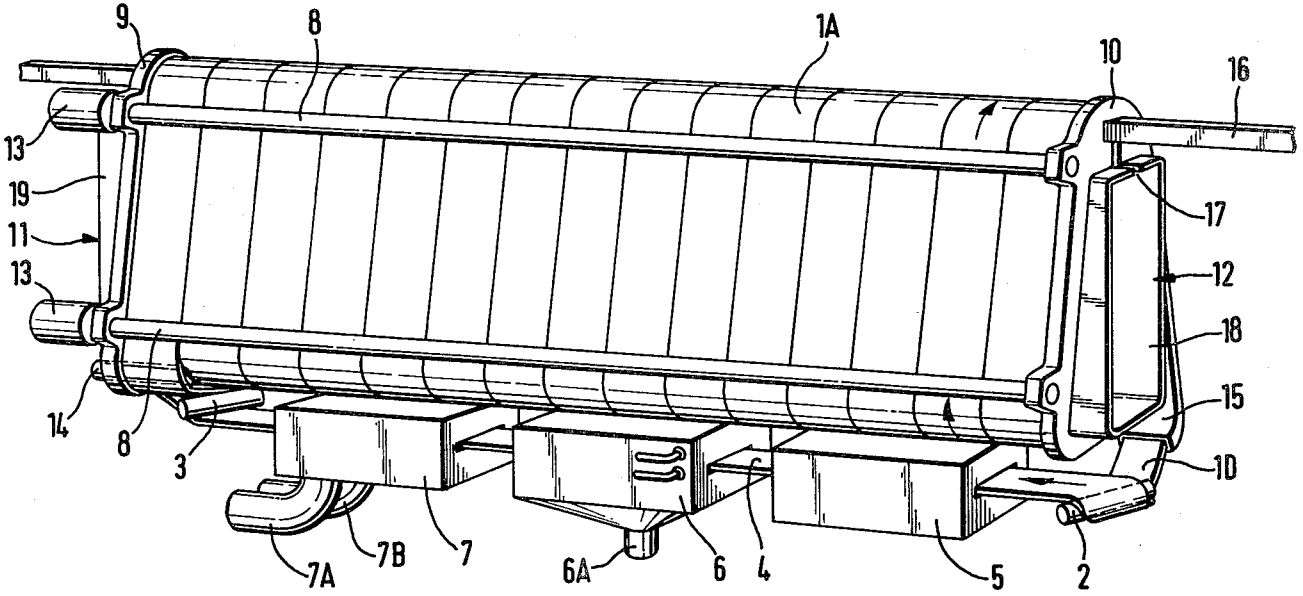
Figure 2:
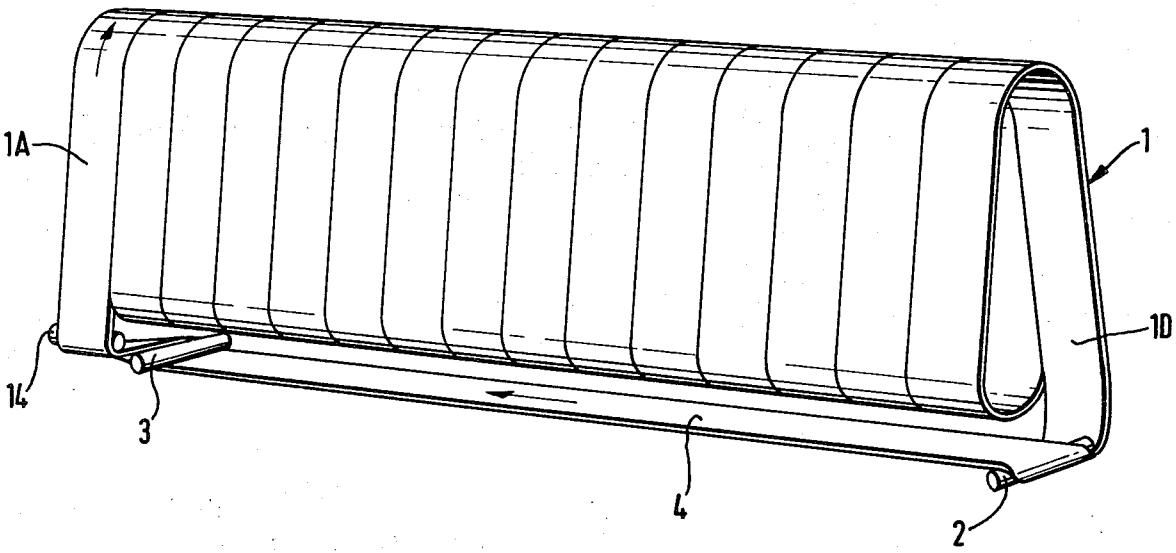
Figure 3:
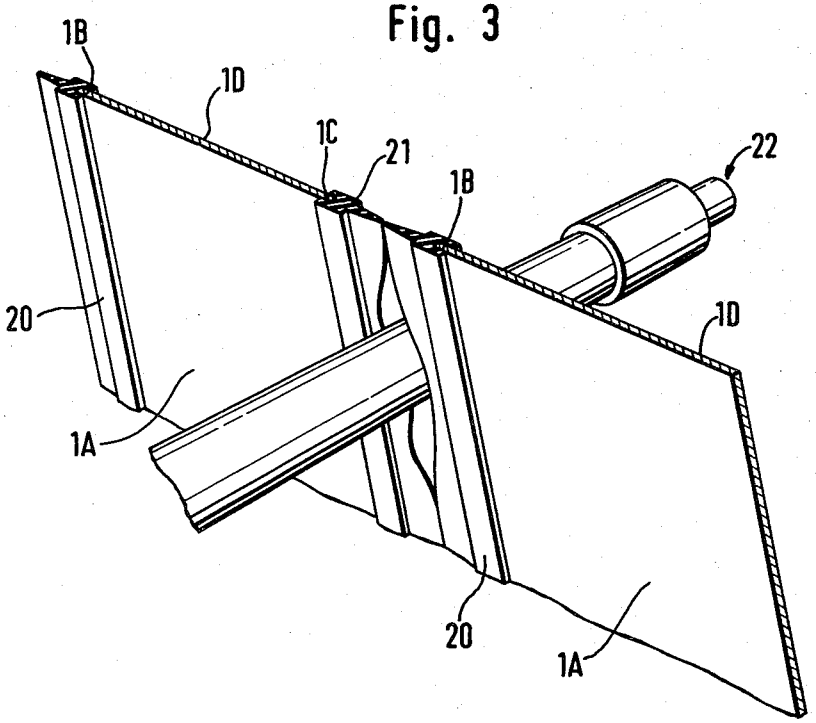
Figure 4:
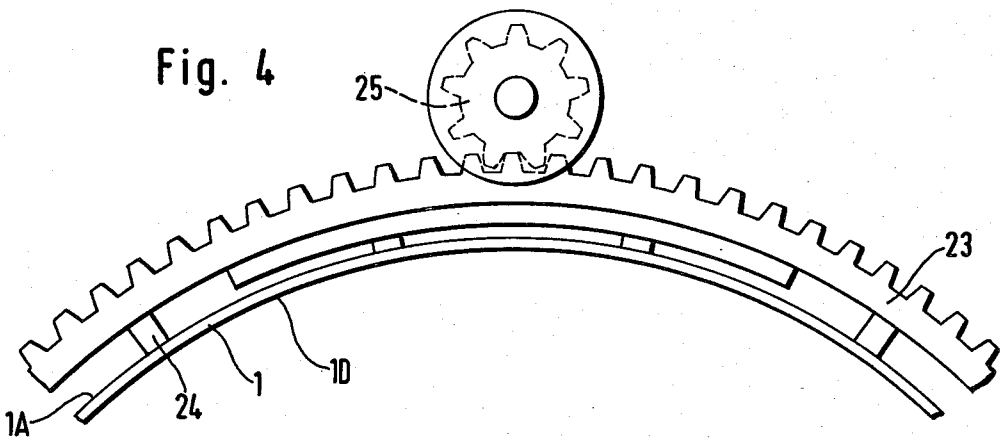
Figure 5:
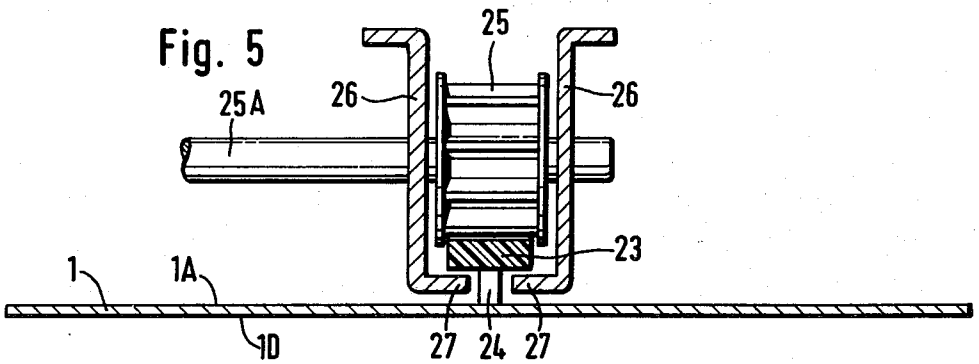

An example of embodiment of the invention is described in the following, reference being made to the accompanying drawings, in which:

FIG. 1 shows the treatment chamber in its position of use with its driving and supporting means and the treatment equipment belonging to the installation, FIG. 2 schematically shows that the treatment chamber is formed by an endless band, FIG. 3 shows the sealing strips of two lateral edges of the band, which sealing strips can bear against each other, and moreover a spray nozzle introduced between said strips, and FIGS. 4 and 5 show an embodiment of a driving means for the band in a side elevational view in the longitudinal direction of the band.

A treatment chamber, which by way of example can be used as a spray booth, is formed by an endless easily flexible band 1, which suitably exhibits good springing properties and is spirally rerouted by means of backing rollers, not shown in the drawings. The band 1, which substantially is made of electrically conducting material, by way of example spring steel, and which preferably is grounded, is rerouted at both ends of the spray booth round rerouting rollers 2 and 3 respectively, which occupy oblique positions, as can be seen in the drawings. The band 1 forms a straight portion 4 between said two rerouting rollers 2 and 3 respectively, along which straight portion different band treatment means are arranged. Said treatment means, which by way of example can comprise a suction device or a burner 5, a washing means 6 and a drier 7, are provided for the removal of objects not desired, such as for example paint, from the band 1. The band 1, which is movably supported by the backing rollers, is driven in the direction of the arrow by means of long driving rollers 8, each one supported in its bay frame 9 and 10 respectively, said bay frames being provided at the input end 11 and the output end 12 respectively of the treatment chamber. The driving rollers 8 are at one of their ends driven by for example a driving motor 13, which is attached to one of the bay frames 9, and the outside of the driving rollers bears against the plane outside 1A of the band 1 and drives the band 1 according to the rotation of the rollers. The bay frame 9, which is located at the input end 11, supports a jockey roller 14 provided to guide the band 1, which is led to the input opening 11 of the treatment chamber, whereas the other bay frame 10 exhibits a snorkellike tubular guide 15, by means of which the outgoing band 2 is guided, when it is fed out from the output end 12 of the treatment chamber.

A supporting means 16 also extends through the treatment chamber and comprises by way of example an endless chain, in which the objects to be treated are suspended and fed forwards through the treatment chamber. The upper portions of the two bay frames 9 and 10 respectively exhibit slits 17, and projecting stiffening flanges 18 and 19 respectively form input and output openings respectively for the objects to be treated.

A sealing strip 20 and 21 respectively is fastened along the lateral edges 1B and 1C respectively of the band 1, said sealing strip with one lateral edge gripping round said lateral edge 1B, 1C of the band and with its other lateral edge forming a resilient seal, which by way of example exhibits a pointed cross-sectional shape. These sealing strips 20, 21 normally bear tight against each other, when the band is moving along the treatment chamber from the input end 11 of the same to its output end 12. However, the resiliency of the strips 20, 21 permits that by way of example one or several spray nozzles 22 for paint are inserted between the two sealing strips 20, 21 at an optional place along the whole extension of the treatment chamber, as is shown in FIG. 3. As is shown in the same figure, the band 1 during its forward displacement moves past the spray nozzle 22, and the sealing strips 20, 21 are pressed round the spray nozzle 22. After the spray nozzle 22 has been passed, the sealing strips 20, 21 substantially resume their original shape and form an effective seal for the treatment chamber. It is of course also possible to introduce other guiding means for the band in order to provide an opening of insertion between two edges of the band in order to insert a treatment means. It can for example be mentioned that the lateral edge of one band portion can be forced to run as in a curve relative to the edge of an adjacent band portion, so that by way of example a spray nozzle for paint can be inserted in the bulge formed in the transversal and longitudinal direction respectively of the band and the treatment chamber.

The mechanism illustrated in FIGS. 4 and 5 can be used for guiding and driving the band 1. Guiding and driving means are provided on the side 1A of the band 1 facing away from the inside of the treatment chamber. In the present case said means comprise a chain or a toothed belt 23, which by means of spacer devices 24 are attached to the band 1. This chain or toothed belt 23 is driven by one or several sprocket wheels or gears 25 supported along the running direction of the band. Said chain or toothed belt 23 is in the longitudinal and running direction of the band guided by guiding means, which in the embodiment shown comprise guiding grooves 26 supported on each side of the chain or the toothed belt 23, said grooves suitably also supporting shafts 27, on which the sprocket wheels or gears 25 are journalled. The guiding grooves can be provided at certain points along the desired running length of the band so that said treatment chamber is formed or else exhibit a spiral-shaped extension and run along the whole desired length for the treatment chamber as a spiral-shaped loop. When the band 1 is driven by means of the sprocket wheels or gears 25 cooperating with the chain or toothed belt 23 it is guided in transversal direction by means of the guiding grooves 26, with the guiding flanges 27 of which the spacer devices 24 of the band 1 then cooperate.

Paint, that is fed out through the nozzles 22 and which does not reach the object to be treated, gets stuck to the inside 1D of the grounded band. This not desired paint on the band 1 is removed, when the band 1 passes through the band treatment means 5–7 previously mentioned. In the suction device or burner 5 the paint in powder form is sucked up or, in case wet paint is used, it is burnt away from the band 1, and at the washing station remaining residues are washed away from the same and fed out through a discharge duct 6A together with the washing liquid. When passing through the drying unit 7 to which and away from which hot air is led and removed respectively through the discharge ducts 7A and 7B respectively, the band 1, 4 is dried before it is conveyed to the entrance of the treatment chamber.

The treatment chamber can of course find other ranges of application than the one just described, by way of example drying plants, washing plants and refrigerating plants. Instead of an endless band a band loop can be used for a reciprocating movement in order to form a treatment chamber in a manner similar to the one described above.

The invention is not limited to the embodiment described above and illustrated in the drawings by way of example only, but can be varied as to its details within the scope of the following claims.

We claim:

1. Treatment chamber intended to be used as a spray booth, comprising an endless band which is spirally rerouted and displaceable in the longitudinal direction of the chamber and forms the lateral walls of the same, and a spray element disposed within the confines of said chamber.

2. Treatment chamber according to claim 1, wherein at least along one lateral edge of the band a sealing strip is provided which in the spirally rerouted condition of the band forms a seal between the lateral edges of the band facing each other, and which is arranged in such a manner that the seal will permit the insertion or withdrawal of said spray element and a continuous seal with respect thereto during rerouting of said band.

3. Treatment chamber according to claim 2, wherein a sealing strip is provided on each lateral edge of said band to form a profiled strip which permits the insertion and reception or spray nozzles between the lateral edges of the band facing each other.

4. Treatment chamber according to any one of claims 1–3, wherein the endless band at both ends of the chamber by means of a roller arrangement is rerouted in order to form a straight band portion which runs through band treatment means including paint collection means, washing means and heating means.

5. Treatment chamber according to claim 1, wherein the band is supported by supporting rollers and rerouted around rerouting rollers which are disposed at an obligue direction relative to the direction of drive of the band.

6. Treatment chamber according to claim 1, wherein a bay frame is provided at the entrance and at the exit respectively of the treatment chamber, between which bay frames are disposed supporting rollers and driving rollers for the band.

7. Treatment chamber according to claim 6, wherein the driving rollers are journalled in the respective bay frames and at one end are driven by a driving motor bearing against the outside of the band when said band forms said chamber, and the band is fed from one end of the chamber to the other end of the same.

8. Treatment chamber according to claim 7 wherein the bay frames are provided with guiding means for the band in order to guide the band to form the treatment chamber and out of the same respectively.

9. Treatment chamber according to claim 6 wherein the bay frames are provided with input and output openings for an endless chain conveyor to support an object to be treated and extending through the treatment chamber.

10. Treatment chamber according to claim 9, wherein the band is supported and driven by means of a chain or a toothed belt provided on the side of the treatment chamber facing inwardly which chain or toothed belt in turn runs through supporting and driving means.

* * * * *